United States Patent [19]

Keller

[11] Patent Number: 4,980,027

[45] Date of Patent: Dec. 25, 1990

[54] VARI-FLOW HEADBOX WITH LARGE AND SMALL FLOW INLET SYSTEMS

[75] Inventor: Martin B. Keller, Hudson Falls, N.Y.

[73] Assignee: Sandy Hill Corporation, Hudson Falls, N.Y.

[21] Appl. No.: 532,795

[22] Filed: Jun. 4, 1990

[51] Int. Cl.[5] ..... D21F 1/02

[52] U.S. Cl. ..... 162/343; 162/336; 162/347

[58] Field of Search ..... 162/336, 343, 344, 272, 162/347

[56] References Cited

U.S. PATENT DOCUMENTS 3,923,593 12/1975 Verseput ..... 162/343

4,804,441 2/1989 Lyytinen ..... 162/336

*Primary Examiner*—Karen M. Hastings

*Attorney, Agent, or Firm*—Ross, Ross & Flavin

[57] ABSTRACT

A stock delivery system is provided having a pair of inlet systems (one for large flow and one for small flow) selectively pivotally swung into operating position for charging a slurry through a perforated plate and into the following flow passage and slice which includes adjustments for optimum flow velocity by strategically-placed pivot points and adjusting mechanisms for controlling the heel and throat areas and the lip defining the slice.

2 Claims, 2 Drawing Sheets

VARI-FLOW HEADBOX WITH LARGE AND SMALL FLOW INLET SYSTEMS

My invention is directed to a novel stock supply system used on a paper machine, which requires, but presently cannot handle, large changes of flow.

In most paper machines, the stock or slurry is fed onto a permeable element, either circular in configuration or elongated in a horizontal or inclined direction, for the formation of the paper web thereupon.

The stock flow approach system on conventional machines normally consists of a fan pump, an approach flow piping, a round-to-rectangular transition piece, a rectangular single tapered header, a perforated plate, and a headbox entry chamber.

For these machine elements to work properly, they have to operate within a limited flow range. This flow range, between a minimum and maximum flow, is in the order of 2.5:1 to 3:1. As such, it is insufficient to cover the requirements of many specialty paper and nonwoven machines.

Such a limited flow range is due principally to the fact that exceeding it would adversely affect stock flow velocity, flow turbulence, friction loss, decay length, settling of fibers, to mention only a few of the critical factors.

Often, particularly in connection with specialty grade machines, requests are made for the manufacture of a very large range of different sheets, which require a very large range of flows.

Here to be appreciated is the fact that a single inlet system can only be designed and built to handle flow ranges of approximately 2½:1 to 3:1. For specialty grade machines, this is often insufficient.

To accommodate to a flow range of approximately 6 to 1, a pair of distinct inlet systems are here envisioned: one to cover the upper flow range and one to cover the smaller flows.

A large header, with its own cooperant perforated plate, is accommodated on its own pivot point so as to be swingable into operational position or into standby position. A small header, with its own cooperant perforated plate, is accommodated on its own pivot point so as to be swingable into operational position or into standby position. The headers and respective perforated plates are used in seriatim or alternatively.

In summary, the invention may be briefly defined as a headbox apparatus for a papermaking machine defining a predetermined machine direction and a predetermined web width in producing a paper web from a preselected infed fiber stock suspension being either in the larger flow range or in the smaller flow range. The headbox apparatus will include a first inlet system for distributing an infed fiber stock suspension having a large flow across the predetermined web width and including a supporting supply line and fan pump, a second inlet system for distributing an infed fiber stock suspension having a small flow across the predetermined web width and including a supporting supply line and fan pump, a nozzle chamber system possessing a channel for through passing the infed fiber stock suspension through the channel and a delivery slice at the outboard terminus of the channel of the nozzle chamber system and defining an adjustable opening width for outfeeding the infed fiber stock suspension. A variable throughpass means allows the varying of the throughpassage of the infed fiber stock suspension by a system of variable first and second perforated plates which accommodate to the first and second inlet systems respectfully and are disposed between the selected inlet system and the channel of the nozzle chamber system. The variable throughpass means can also consist of a plurality of control devices for controlling a predeterminate quantity of infed fiber stock suspension delivered by the selected inlet system to the nozzle chamber system and being interposed therebetween and being in the form of first and second perforated plates configured for accommodating the first and second inlet systems.

The two inlet versions comprise a primary large inlet system 10 and a secondary small inlet system 20.

Figures 1, 3:
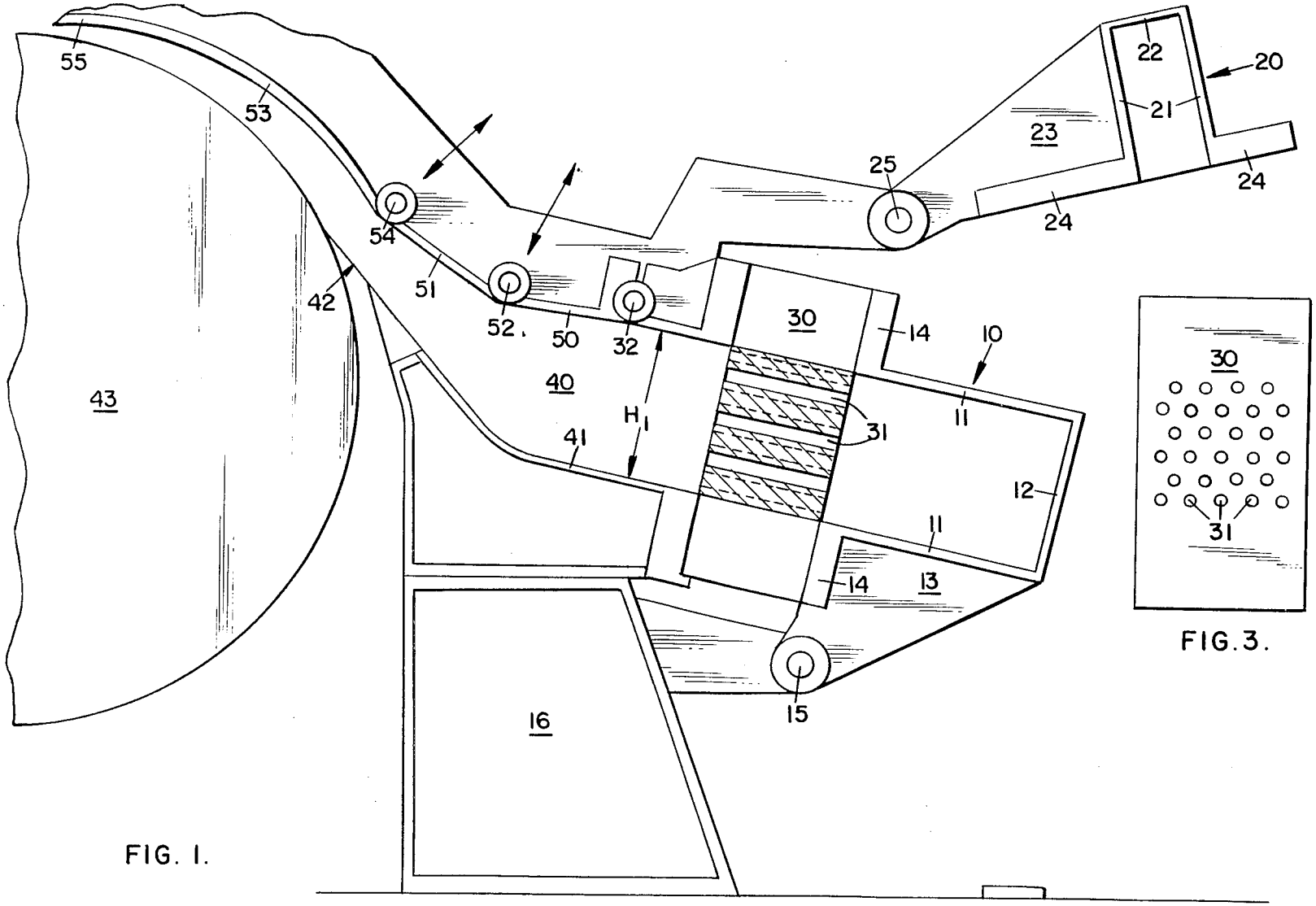
FIG. 1 is a schematic view showing the primary large inlet system in operative position, and the secondary small inlet system in nonoperative or standby position.
FIG. 3 is a view in front elevation of the primary perforated pate of the invention.
Figure 2:
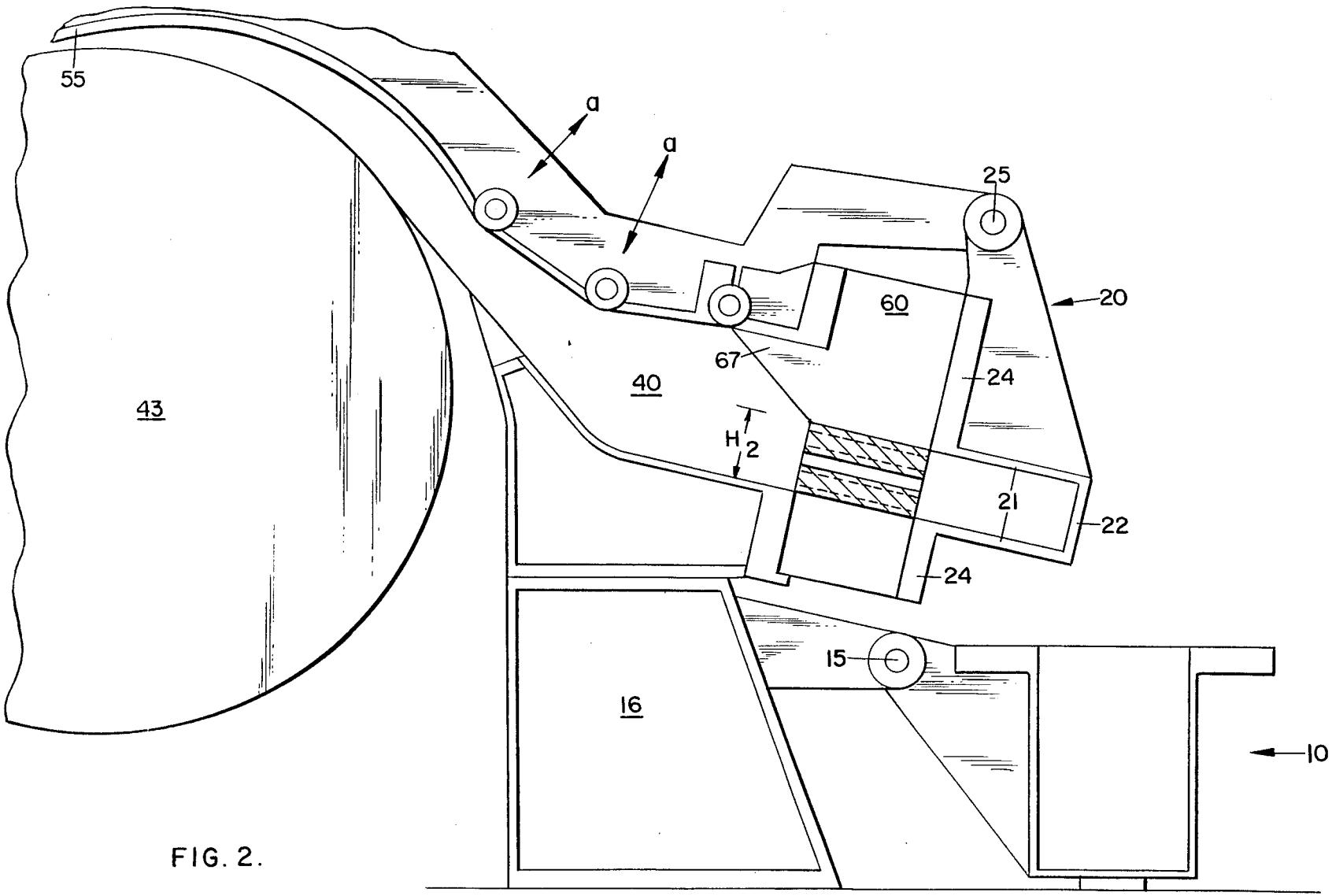
FIG. 2 is a schematic view showing the secondary small inlet system in operative position and the primary large inlet system in nonoperative position.

In FIG. 1, primary large inlet system 10 is shown as in its operative position, while secondary small inlet system 20 is in the nonoperative position. In FIG. 2, the converse is true, primary system 10 is shown as nonoperative and secondary system 20 is shown as operative.

Primary large inlet system 10 comprises opposite side walls 11, a bottom or outboard tapered wall 12, an end wall (not shown) opposite from the wall through which the connecting supply line (not shown) extends, and at its inboard open confrontation side is provided with outwardly extending confronting flanges 14, 14. One or more gussets 13 will strengthen the inlet system.

The subassembly is pivotal on a pivot 15, supported by machine side frames, one of which is shown and is numbered 16.

Secondary small inlet system 20 comprises opposite walls 21, a bottom or outboard tapered wall 22, and end wall (not shown) opposite from the wall through which the connecting supply line extends (and not shown). At its inboard open confrontation side, it is provided with outwardly extending confronting flanges 24, 24. This subassembly is pivoted on a pivot 25 supported by the machine side frames at opposite sides of the machine.

Each system is connected to respective approach flow piping and fan pump, same not being shown, they being conventional.

A pair of interchangeable, generally rectangular, perforated plates are employed.

A larger primary perforated plate 30 is used when the primary large inlet system is rendered operative, and will be sure to include a plurality of through apertures 31, preferably of circular cross section, same being equispaced as to rows thereof, and preferentially, staggered as to each other in the successive rows. That is, the apertures are arranged as banks, both horizontally and vertically with reference to the perforated plate dimensions.

If desired, perforated plates 30 and 60 may be attached to their respective inlet systems 10 and 20 and in each instance will form an integrated subassembly.

The headbox and inlet chamber is comprised of an uppermost wall made up of wall portions 50 and 51 and 53 interjoined across the machine width by knuckles 32, 52, and 54 which, being operated by a conventional supporting adJusting mechanisms, allows the warping of the respective wall or roof defining portions inwardly toward or outwardly away from the flow passage as indicated by arrow a.

This positioning of the outside wall permits the regulation of the flow velocities for the various flows of operating conditions.

The flow passage can be described as having a lip portion 55 and an intermediate heel portion defined by wall portions 50 and 51 for the upper wall and apron 42 for the lower wall.

The stock is fed through the nozzle duct which terminates at its outboard end at the permeable element and which is closed laterally by the lip which is adjustable relative to the permeable element to adjust the height of the opening of the lip or nozzle duct at what is termed the slice.

The slurry is thus discharged onto a vacuum breast roll 43 which may be of the type found in the case of a conventional cylinder machine or may be of the type around which a Fourdrinier wire of the straight horizontal or inclined run type is entrained.

Each perforated plate is capable of being swung on its pivot point for purposes of inspecting and/or cleaning, it being understood that such is allowable when and if both primary and secondary inlet systems are swung into their respective standby positions.

The slurry is charged through the apertures of the perforated plate from its inlet side to its outlet side and thereinto the headbox.

In the case of the primary large inlet system, the height of the charge of the slurry into the headbox will be seen to be delineated as H1, representative of the full height of the headbox.

Reference is now made to smaller secondary perforated plate 60, distinguishable from larger perforated plate 30 in the respect that it is provided with a nosepiece or transition piece 67 provided as an integral part of the perforated plate and serves to assure a correct flow transition.

The smaller perforated plate is used for the lower flow range.

The secondary system will be seen to have a smaller crossflow spread so as to discharge the slurry at a height H2 into the headbox chamber having the aforementioned height delineated H1.

I claim:

1. A headbox apparatus for a papermaking machine defining a predetermined machine direction and a predetermined web width in producing a paper web from a preselected infed fiber stock suspension being either in a large flow range or in a small flow range relative to said large flow range, said headbox apparatus comprising:

a first inlet system for distributing an infed fiber stock suspension having a large flow across the predetermined web width and connected to a first supporting supply line and fan pump, a second inlet system for distributing an infed fiber stock suspension having a small flow relative to said large flow across the predetermined web width and connected to a second supporting supply line and fan pump, a nozzle chamber system possessing a channel for through passing the infed fiber stock suspension through the channel and a delivery slice at an outboard terminus of the channel of the nozzle chamber system and defining an adjustable opening width for outfeeding the infed fiber stock suspension, means for selectively pivotally swinging each of said first and second inlet systems between an operative position and an inoperative position in relationship to said nozzle chamber system, a variable throughpass means for varying the through passage of the infed fiber stock suspension consisting of variable first and second perforated plates for accommodating the first and second inlet systems and disposed between the selected inlet system and the channel of the nozzle chamber system.

2. A headbox apparatus for a papermaking machine defining a predetermined machine direction and a predetermined web width in producing a paper web from a preselected infed fiber stock suspension being either in a large flow range or in a small flow range relative to said large flow range, said headbox apparatus comprising:

a first inlet system for distributing an infed fiber stock suspension having a large flow across the predetermined web width and connected to a supporting supply line and fan pump, a second inlet system for distributing an infed fiber stock suspension having a small flow relative to said large flow across the predetermined web width and connected to a supporting supply line and fan pump, a nozzle chamber system possessing a channel for through passing the infed fiber stock suspension through the channel and a delivery slice at an outboard terminus of the channel of the nozzle chamber system and defining an adjustable opening width for outfeeding the infed fiber stock suspension, means for selectively pivotally swinging each of said first and second inlet systems between an operative position and an inoperative position in relationship to said nozzle chamber system, a variable throughpass means consisting of a plurality of control devices for controlling a predeterminate quantity of infed fiber stock suspension delivered by the selected inlet system to the nozzle chamber system and being interposed therebetween and being in the form of first and second perforated plates configured for accommodating the first and second inlet systems respectively.

* * * * *